US012473121B1

(12) United States Patent
Smith et al.

(10) Patent No.: US 12,473,121 B1
(45) Date of Patent: Nov. 18, 2025

(54) CAN WIPER

(71) Applicants: Lary C. Smith, Anchorage, AK (US); John D. Foster, Anchorage, AK (US)

(72) Inventors: Lary C. Smith, Anchorage, AK (US); John D. Foster, Anchorage, AK (US)

( * ) Notice: Subject to any disclaimer, the term of this patent is extended or adjusted under 35 U.S.C. 154(b) by 0 days.

(21) Appl. No.: 18/939,789

(22) Filed: Nov. 7, 2024

(51) Int. Cl.
*B65D 23/06* (2006.01)

(52) U.S. Cl.
CPC ..... *B65D 23/06* (2013.01)

(58) Field of Classification Search
CPC ..... A45D 40/267; B65D 23/06
USPC ..... 215/386
See application file for complete search history.

(56) References Cited

U.S. PATENT DOCUMENTS

2013/0101337 A1* 4/2013 Kulik ..... A45D 40/267
401/122

* cited by examiner

*Primary Examiner* — Anthony D Stashick
*Assistant Examiner* — L Kmet

(57) ABSTRACT

An exemplary can wiper that may be inserted into the opening of a container of product, which allows excess product to be removed from an applicator as the applicator is pulled from the container through the can wiper.

18 Claims, 10 Drawing Sheets

Prior Art Dispenser Container

CAN WIPER

BACKGROUND

Various containers, such as shown in FIG. 1, are equipped with an applicator integral to or coupled to the lid of the container. In such arrangements, the built-in applicator provides a convenient way for the user to apply product from the container without the necessity of a separate applicator to be additionally obtained, and that can get lost or separated from the container. Further, the built-in applicator allows the user to keep the lid in the user's hand during product application, making it easier to replace the lid after use.

Such containers are often used with products for coupling and fusing sections of polymer tubes and pipes and their related fittings. For example, Polyvinyl Chloride (PVC) and Acrylonitrile Butadiene Styrene (ABS) tubes, pipes, and fittings can be glued together for secure air and liquid-tight joints. When properly coupled, such tubes, pipes, and fittings can be used to transport pressurized gases and liquids.

When fusing the polymer sections, the ends of the sections to be glued together are first prepared with a liquid primer and are then coated with a glue or cement. Usually both sections to be fused together are prepared with the primer and the glue, and then they are pressed together. Often both the primer and the glue are stored in containers such as illustrated in FIG. 1. The user removes the lid of the container, which also pulls the applicator from the container. The applicator is generally saturated with the liquid product from the container. The user can remove some excess product from the applicator by wiping the applicator around the inside of the opening of the container prior to applying the product to the sections to be fused. After applying the product, the applicator and lid are returned to the container and the lid can be secured to the container by screwing the inner fastening threads of the lid to the outer fastening threads of the opening, for example.

Unfortunately, as convenient as the process described above can be, it can also be time-consuming, messy, and wasteful. Wiping the applicator for each application takes time and can slow down a larger project. The applicator almost always has a lot of excess product saturating the applicator, which can still drip off the applicator even after wiping the applicator around the inside of the container opening. Product is often wasted as it falls off the applicator when the applicator is moved between the container and the project sections.

BRIEF DESCRIPTION OF THE DRAWINGS

The detailed description is set forth with reference to the accompanying figures. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

The subject matter of the present disclosure is described with specificity to meet statutory requirements. However, the description itself is not intended to limit the scope of this disclosure. Rather, the claimed or disclosed subject matter might also be embodied in other ways to include different components, steps, or combinations thereof similar to the ones described in this document, in conjunction with other present or future technologies. Terms should not be interpreted as implying any particular order among or between various steps disclosed herein unless and except when the order of individual steps is explicitly described.

For purposes of this disclosure, the word "including" has the same broad meaning as the word "comprising." In addition, words such as "a" and "an," unless otherwise indicated to the contrary, include the plural as well as the singular. Thus, for example, the constraint of "a feature" is satisfied where one or more features are present. Also, the term "or" includes the conjunctive, the disjunctive, and both (a or b thus includes either a or b, as well as a and b).

Figure 1:
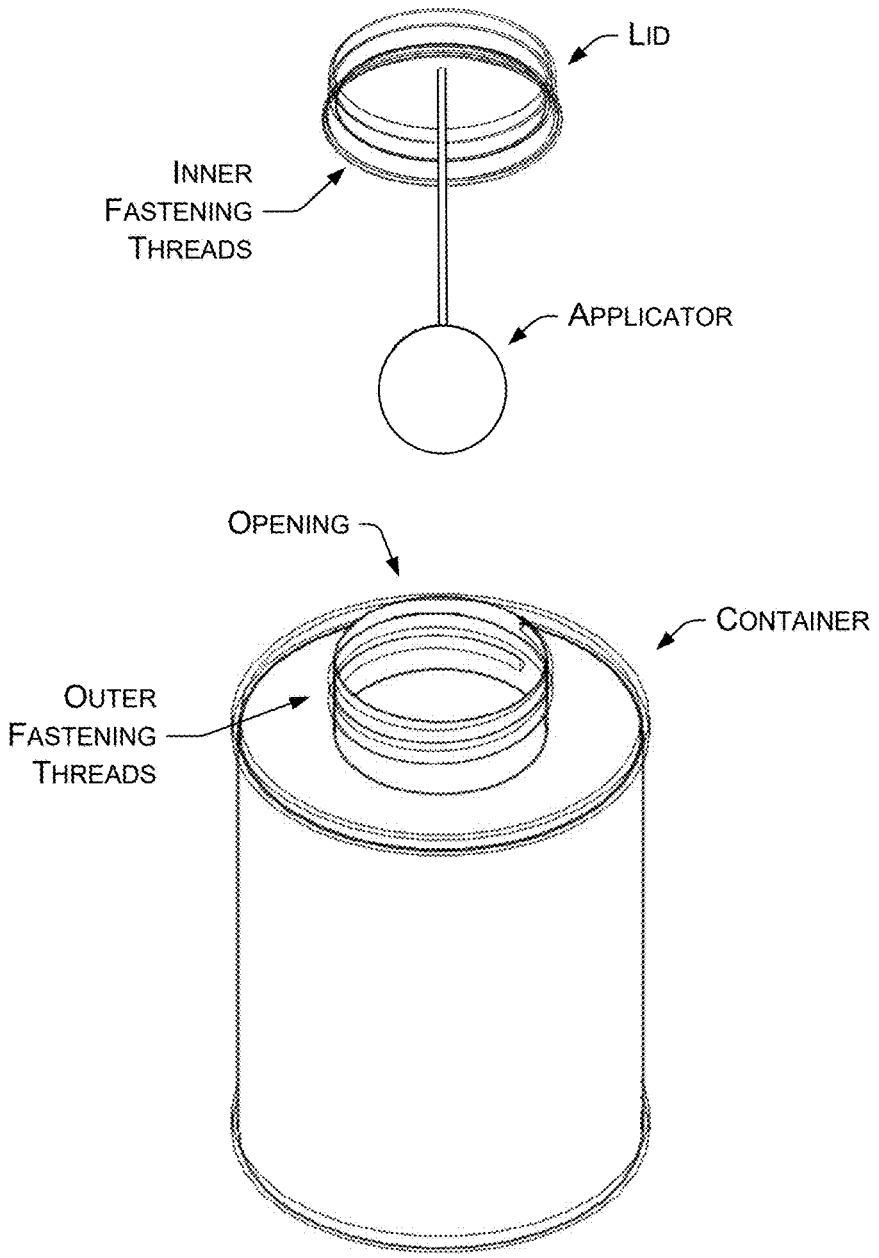
FIG. 1 is a perspective view of an example container and lid with applicator.

Referring to FIG. 1, various industries use containers to contain products including liquids, in some examples glue or cement for fusing polymer sections together. In some cases, the lid of the container includes an integrated or built-in applicator, such as a dauber, brush, or the like, which can be used to apply the product to the sections. Many times, the applicator is saturated with the product, and product drips or falls from the applicator, creating waste and mess. While the applicator can be wiped on the opening of the container when removing the applicator from the container, doing so can make the container messy and may not remove enough product from the applicator to avoid dripping product from the applicator.

Figure 2:
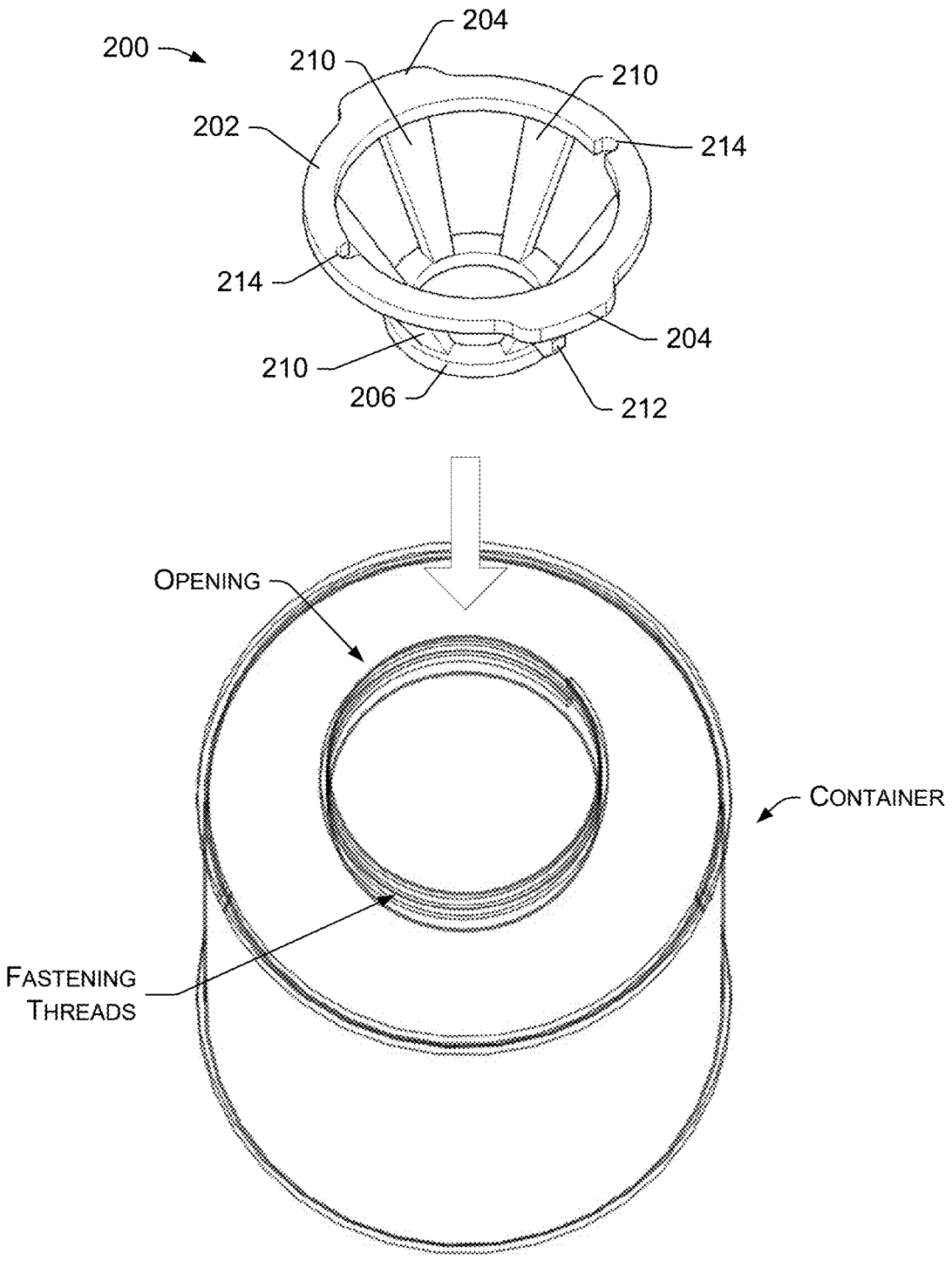
FIG. 2 is a perspective view of an example container, and an example can wiper that can be inserted into the opening of the container, according to an embodiment.
Figure 3:
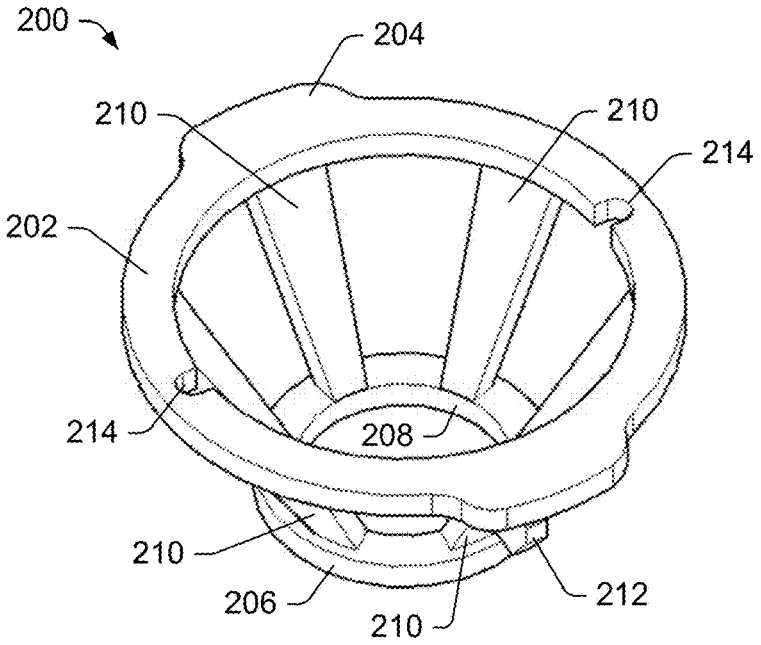
FIGS. 3 and 4 are perspective views of a top and a bottom, respectively, of an example can wiper, according to an embodiment.
Figure 4:
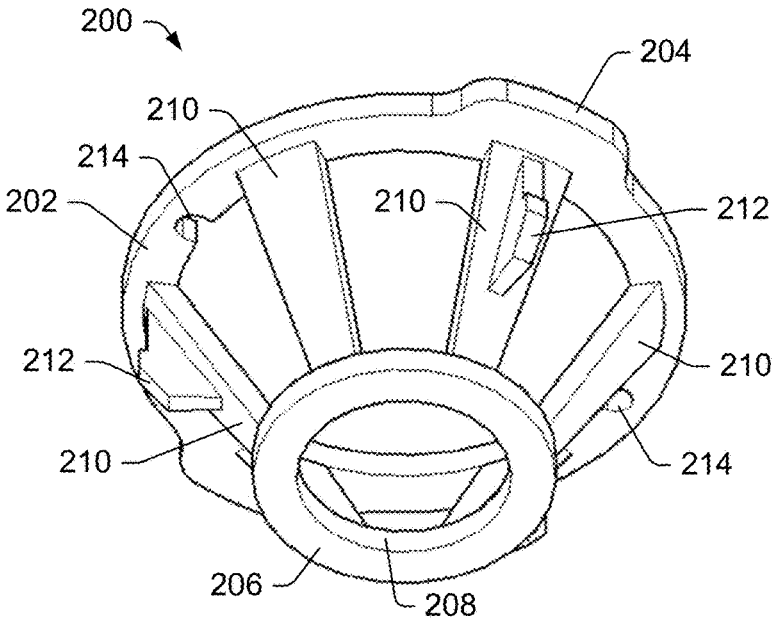
Figure 5:
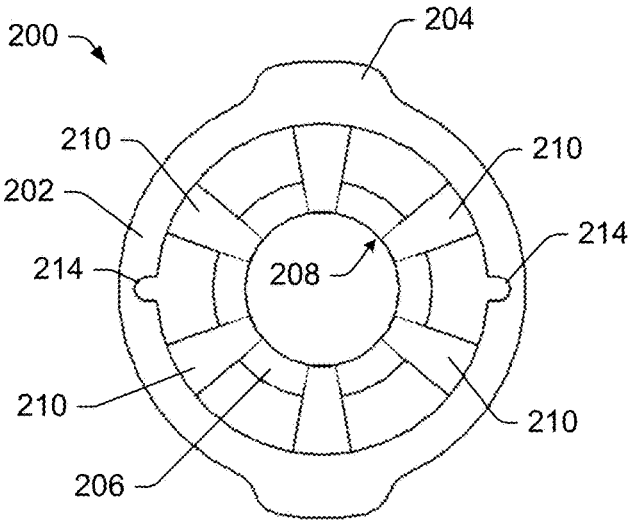
FIGS. 5, 6 and 7 are a top view, a bottom view, and a side view, respectively, of the example can wiper of FIGS. 3 and 4, according to the embodiment.
Figure 6:
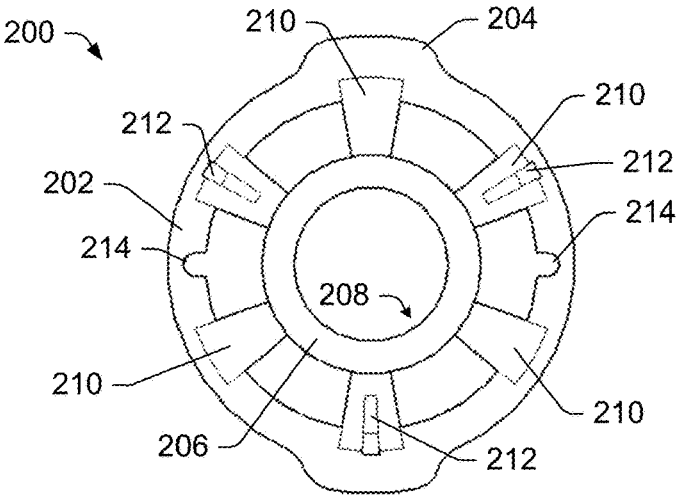
Figure 7:
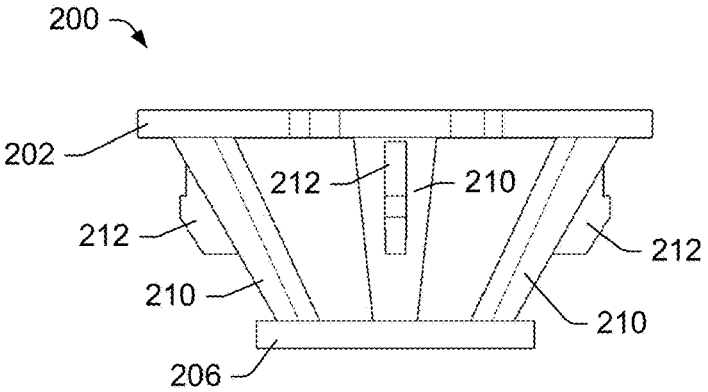
Figure 8:
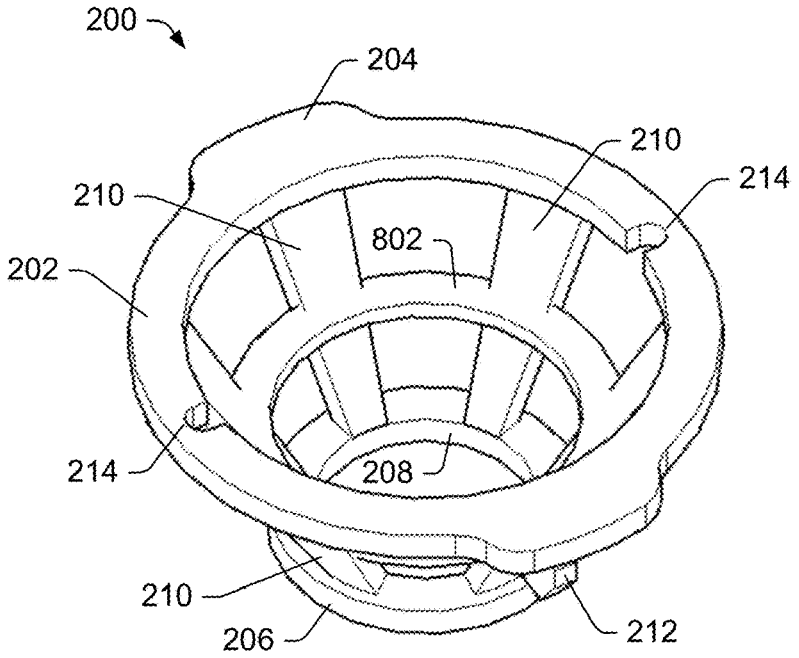
FIGS. 8 and 9 are perspective views of a top and a bottom, respectively, of an example can wiper, according to another embodiment.
Figure 9:
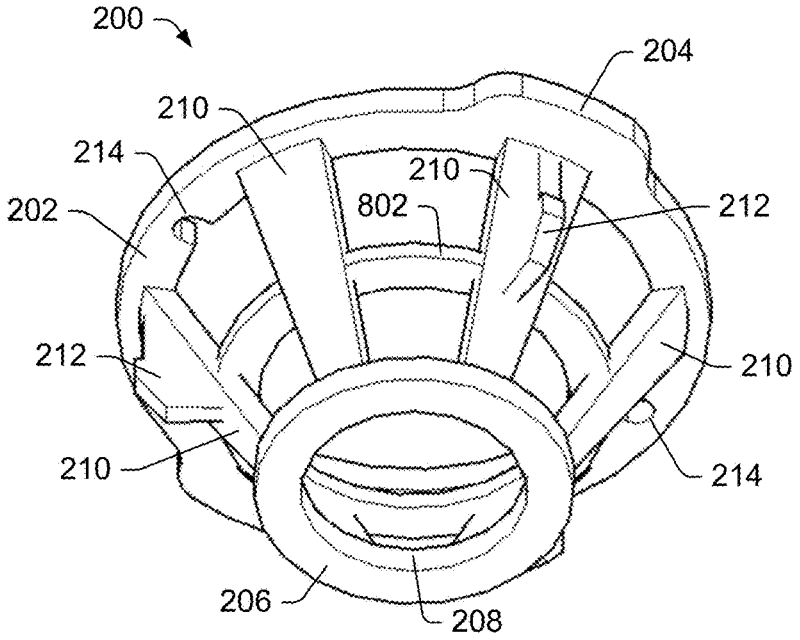
Figure 10:
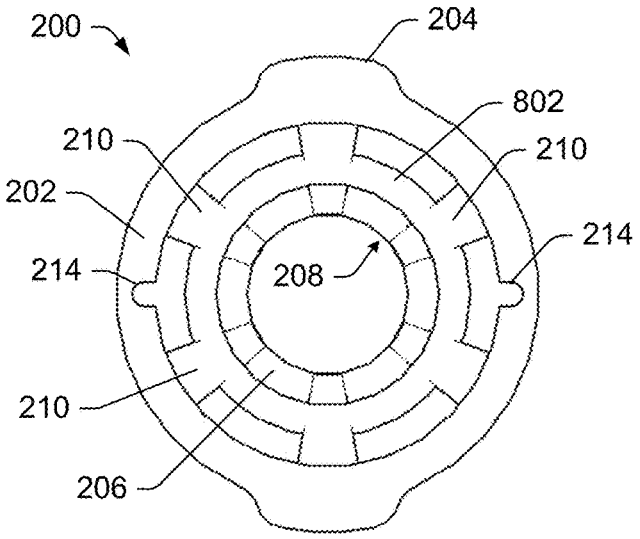
FIGS. 10, 11, and 12 are a top view, a bottom view, and a side view, respectively, of the example can wiper of FIGS. 8 and 9, according to the embodiment.
Figure 11:
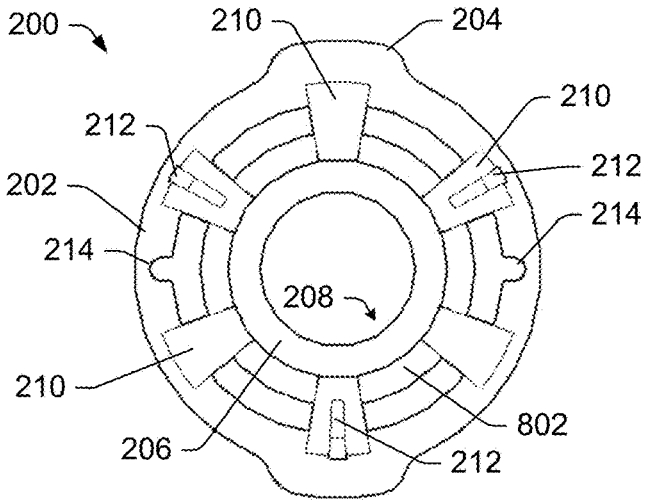
Figure 12:
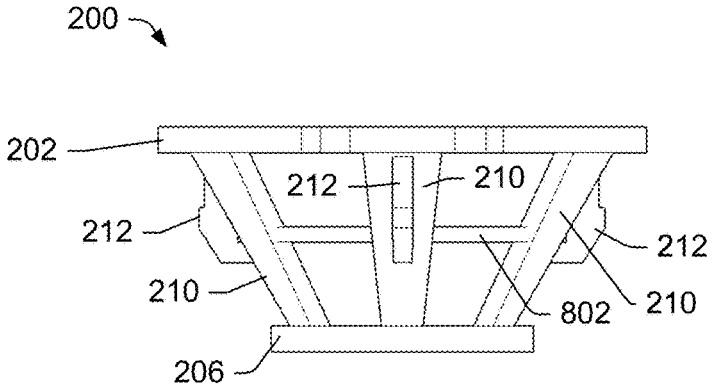
Figure 13:
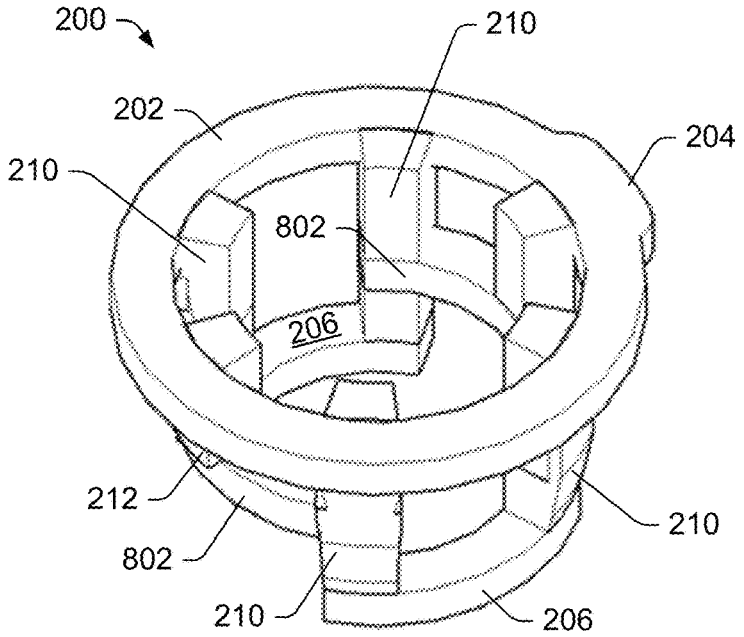
FIGS. 13 and 14 are perspective views of a top and a bottom, respectively, of an example can wiper, according to another embodiment.
Figure 14:
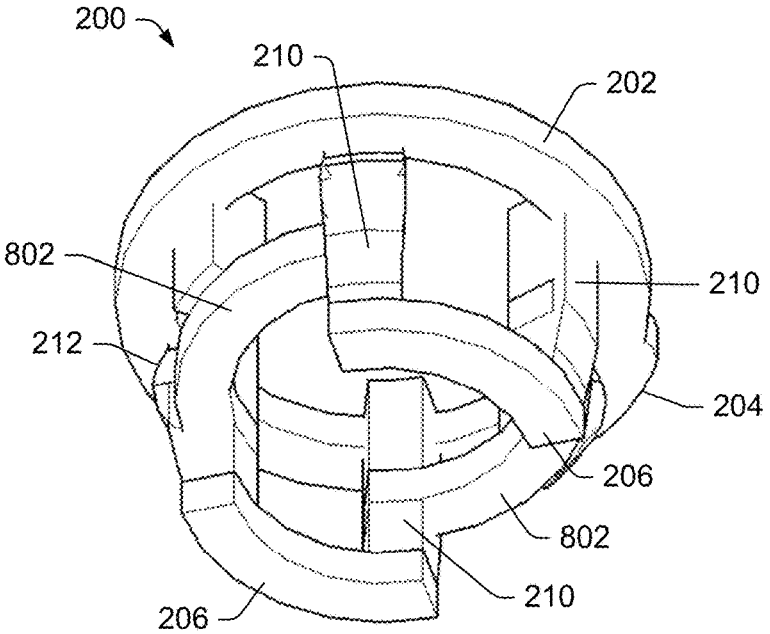
Figure 15:
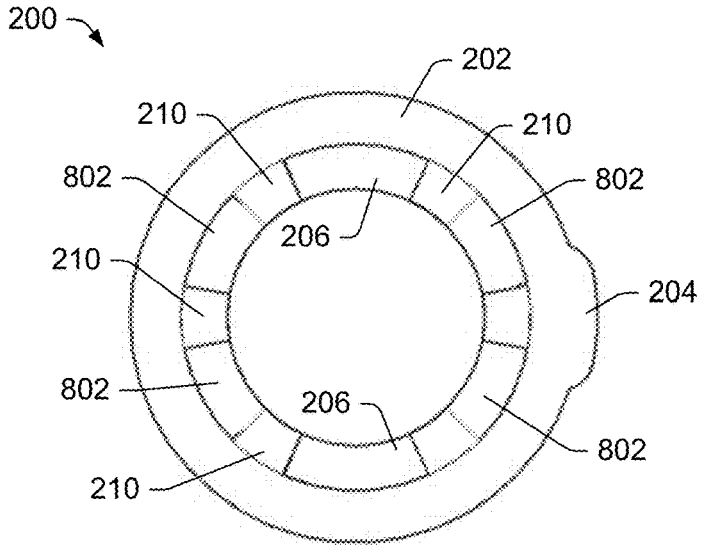
FIGS. 15, 16, and 17 are a top view, a bottom view, and a side view, respectively, of the example can wiper of FIGS. 13 and 14, according to the embodiment.
Figure 16:
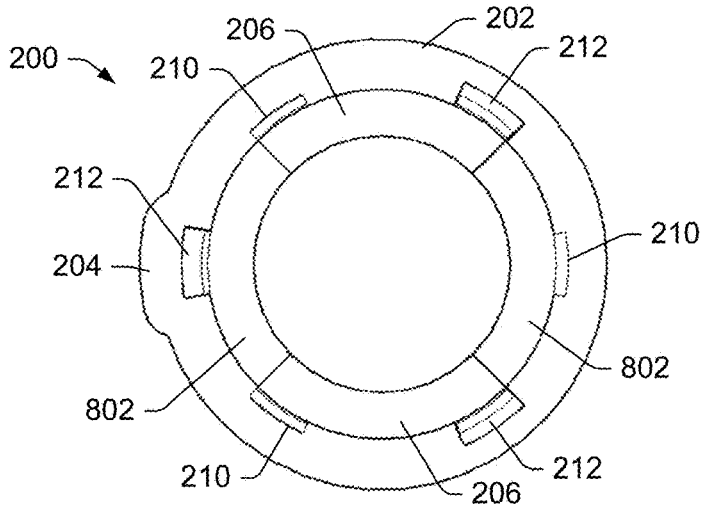
Figure 17:
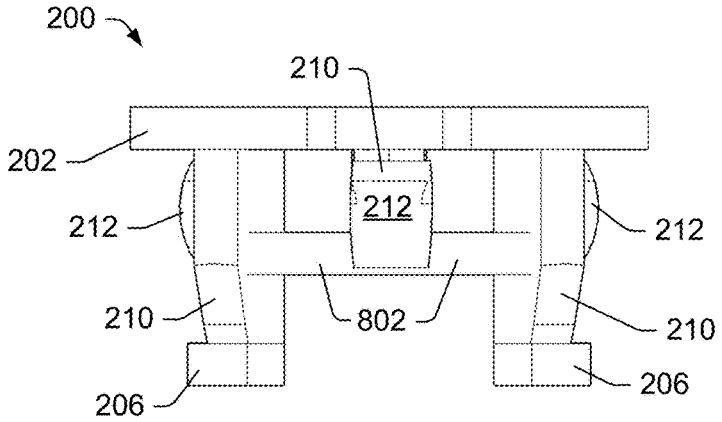
Figure 18:
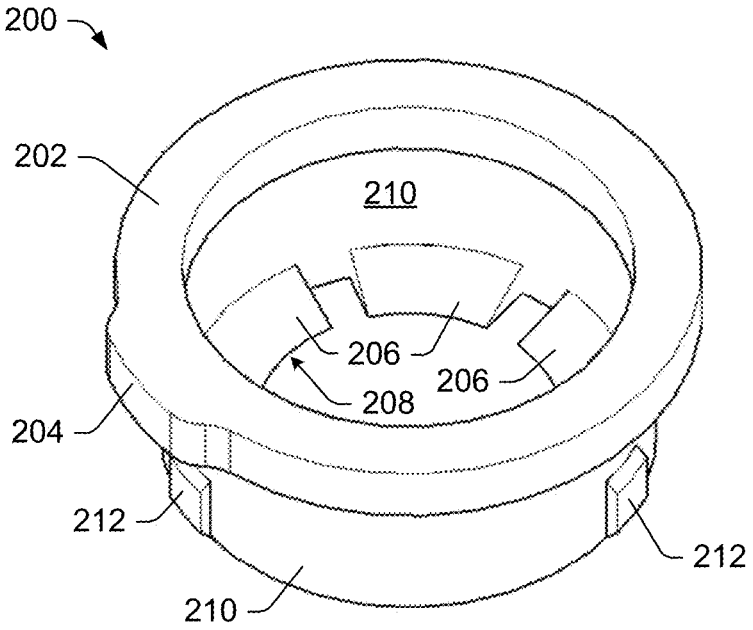
FIGS. 18 and 19 are perspective views of a top and a bottom, respectively, of an example can wiper, according to another embodiment.
Figure 19:
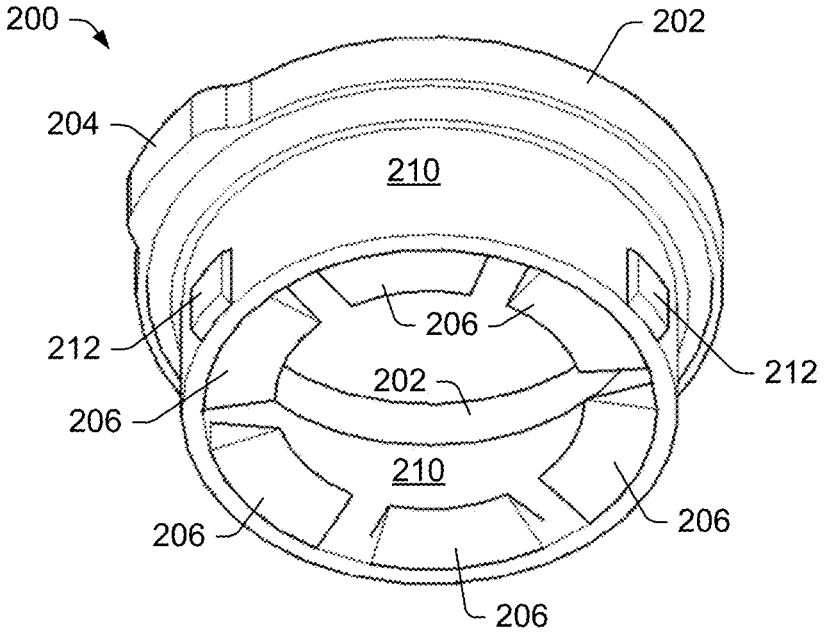
Figure 20:
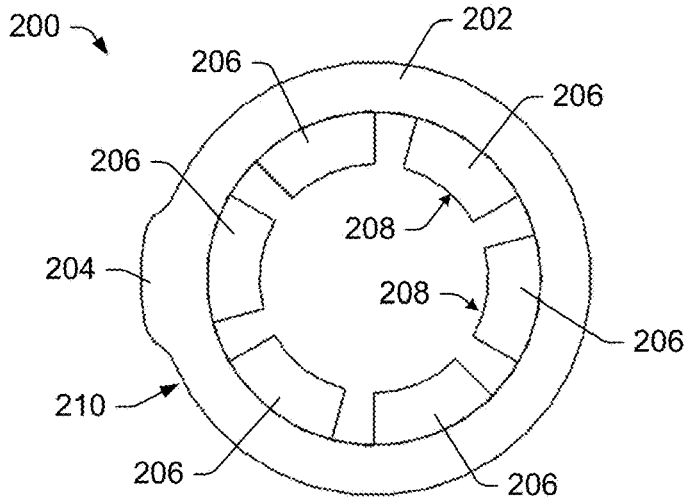
FIGS. 20, 21, and 22 are a top view, a bottom view, and a side view, respectively, of the example can wiper of FIGS. 18 and 19, according to the embodiment.
Figure 21:
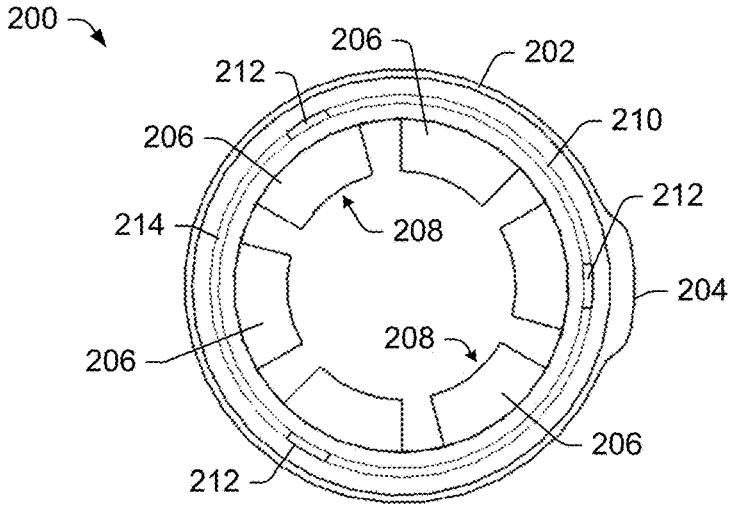
Figure 22:
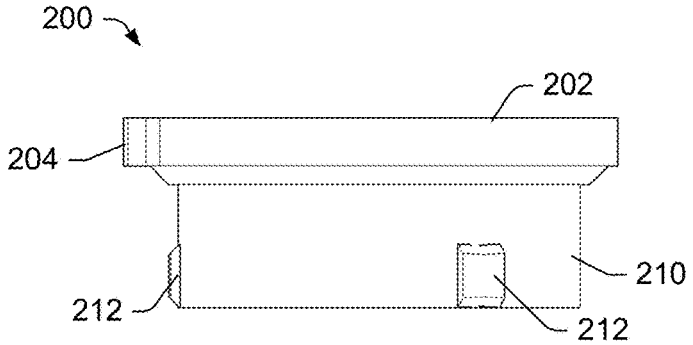

FIG. 2 shows an example can wiper 200 that can be used with such containers or other types and shapes of containers also. The can wiper 200 can be inserted into the opening of the container, so that most of the can wiper 200 is disposed within the container, but the outer rim 202 of the can wiper 200 can remain outside the container. This prevents the can wiper 200 from falling into the container and allows the can wiper 200 to be removed from the container if desired. The outer rim 202 comprises a rigid or semi-rigid generally circular upper support component of the can wiper 200. The outer rim 202 can be configured to have a diameter equal to or somewhat larger than the diameter of the opening of the container, so as to sit on the upper rim of the container opening when the can wiper 200 is inserted into the opening. In embodiments where the outer rim 202 is small enough to fit inside the opening of the container, the outer rim 202 also includes one or more features (such as tabs 204) that protrude from the outer rim 202 to engage the upper rim of the container opening. Also, in some cases, the outer rim 202 may include one or more tabs 204 (which can be the same tabs 204 or others) that can be grasped to remove the can wiper 200 from the container. The tabs 204 may be integral to the outer rim 202 and protrude from the outer rim 202, and in some embodiments, can engage the upper rim of the container opening.

In various embodiments, the can wiper 200 includes a lower wiper ring 206 that is configured to wipe the applicator of excess product as the applicator passes through the ring 206. The ring 206 comprises a rigid or semi-rigid lower support and wiping/scraping component of the can wiper 200. For example, when the can wiper 200 is installed in the opening of the container, the applicator passes through the can wiper 200 and through the ring 206 to access the product in the container or to seal the container. The ring 206 may be generally smaller in diameter than the end of the applicator or may have a shape that facilitates the wiping or scraping of the applicator as the applicator passes through the ring 206. Further, the radius of the outer rim 202 may be greater than a radius of the ring 206, making the overall shape of the can wiper 200 have a tapered profile or resemble a truncated conical section. While the ring 206 may be shaped as a circle or ellipse, the ring 206 may also be shaped as a polygon or other shape to optimize wiping the applicator or for convenience or structural strength of the can wiper 200. In some cases, the ring 206 may be shaped as a slotted opening, or a like shape. Although the ring 206 may comprise any of these or other shapes, it is referred to as the "ring 206" or "wiper ring 206" herein, for convenience of this disclosure.

As the applicator is pulled from the container and passes through the ring 206, the ring 206 wipes or scrapes excess product from the applicator. The user can also pull the applicator against the ring 206 when removing the applicator from the container. Accordingly, the inside surface 208 of the ring 206 may have a smooth profile, a rough profile, a featured profile, an angled profile, a rounded profile, a squared profile, or another shape or profile arranged to optimize wiping excess product from the applicator. The shape and/or profile of the inside surface 208 of the ring 206 may depend on the type of applicator, the material or shape of the applicator, or the type of product in the container, for optimal performance.

Referring also to FIGS. 3-6, a wiper ring 206 can comprise one or more discrete sections. For instance, the ring 206 may be continuous, comprising an unbroken shape or form. Alternately, the ring 206 may be non-continuous (i.e., discontinuous), comprising two or more sections or portions (see below). Whether the ring 206 has a continuous shape or a non-continuous shape, the ring 206 is disposed below the outer rim 202, within the container, and is arranged to contact (to squeeze, scrape, wipe, etc.) the applicator as the applicator passes the ring 206, or passes through the ring 206, while the applicator is being removed from the container. Note that the performance of the ring 206 and the can wiper 200 does not depend on having an applicator that is integral to or coupled to the container lid—separate applicators are also contemplated in the disclosure and the function and performance of the ring 206 and the can wiper 200 is equally effective with separate applicators.

In the embodiments, the ring 206 is coupled to the outer rim 202 via one or more vanes 210. The vanes 210 comprise substantially planar components that extend from the outer rim 202 to the ring 206 to support the ring 206 as it is disposed within the container. An example can wiper 200 may include multiple vanes 210 that can be spaced apart to allow product to flow between the vanes 210 and back into the container. Alternatively, the multiple vanes 210 may not be substantially spaced apart, or a single vane 210 may be used instead of multiple vanes 210. Thinner vanes 210 can be planar or can have a polygonal rail shape. Wider vanes 210 can be planar or can have a curved shape, as the vanes 210 are disposed around the perimeter of the generally circular outer rim 202. In some cases, a curved shape of the vanes 210 can be approximated by a quantity of planar portions disposed at angles one to another. As the vanes 210 extend from the outer rim 202 to the ring 206, the vanes 210 may do so in a straight path or a curved path (either concave, convex, or a combination). Note that in some of the illustrations of FIGS. 2-22, not all of the vanes 210 illustrated may be labeled, for simplicity and clarity of the drawings.

In some embodiments, as shown in the illustrations, one or more of the vanes 210 may include a securing member 212 protruding from the vane 210. The securing member 212 may be integral to the vane 210 and may comprise a protruding structure with one or more retention features. The securing member 212 extends outward from the vane 210 and includes one or more retention features that grasp or press against an inner surface of the container or the container opening to secure the can wiper 200 to the container. For instance, when the can wiper 200 is inserted into the container, the securing member(s) 212 may press snugly against the inner surface of the container opening. In some cases, as the can wiper 200 is fully inserted into the container, the securing member(s) 212 may relax into a position that holds the can wiper 200 in place. For example, the can wiper 200 may "snap" into place within the container opening, with retention features (e.g., notch, tab, groove, etc.) of the securing member 212 engaged with one or more features (e.g., ridge, recess, edge, etc.) of the container.

Removing the can wiper 200 from the container opening can require some force, as the securing member(s) 212 press against the inside surface of the container. In some cases, the user may grasp the tab(s) 204 to pull the can wiper 200 out of the container by the outer rim 202. In some embodiments, the outer rim 202 includes one or more stress relief notches 214 that allow the outer rim 202 to bend or flex at the notches 214, making removal (or insertion) of the can wiper 200 somewhat easier. The notches 214 can comprise a cut-out section of the outer rim 202, creating a more flexible portion of the outer rim 202 at the location of the notches 214.

In some cases, it may be desirable to remove the can wiper 200 from the container prior to fastening the lid on the container. However, in many cases, the can wiper 200 is sized and configured to remain within the container, with the outer rim 202 in place on the opening of the container when the lid is fastened to the container. For such containers, when the lid is positioned above the opening and the can wiper 200, the applicator is inserted through the can wiper 200, through the ring 206, and into the product within the container. The lid may then be fastened onto the opening of the container if desired. In some examples, the lid is fastened to the container by screwing the inner fastening threads of the lid onto the outer fastening threads of the container opening. However, other types of lid-fastening techniques and devices are also contemplated, including friction fittings, twist-lock fittings, press-fit or snap fittings, and so forth.

As mentioned above, when the lid is removed, the applicator, which may be coupled to the lid, is pulled through the ring 206 of the can wiper 200, which wipes or scrapes off excess product from the applicator. The applicator can then be used and replaced in the container when finished.

Referring to FIGS. 8-12, in some embodiments, the can wiper 200 includes one or more intermediate rings 802. An intermediate ring 802 comprises a full or partial ring structure that is disposed between the outer rim 202 and the lower ring 206. An intermediate ring 802 can be disposed parallel to the outer rim 202, the ring 206, or both. The intermediate ring 802 can also be integral to or coupled to the one or more vanes 210. For example, in an embodiment, an intermediate ring 802 can be coupled to the outer rim 202 via one or more vanes 210. Accordingly, the intermediate ring 802 can provide additional structure to the can wiper 200 and can also provide one or more additional surfaces or edges for wiping or scraping product from the applicator when the applicator is brought up through the can wiper 200.

An inside surface of the intermediate ring(s) 802 may have a smooth profile, a rough profile, a featured profile, an angled profile, a rounded profile, a squared profile, or another shape or profile. While the intermediate ring 802 may be shaped as a circle or ellipse, the intermediate ring 802 may also be shaped as a polygon or other shape to optimize wiping the applicator or for convenience or structural strength of the can wiper 200.

In various embodiments, an intermediate ring 802 comprises one or more discrete sections. An intermediate ring 802 may be continuous, comprising an unbroken shape or form. Alternately, the intermediate ring 802 may be non-continuous (i.e., discontinuous), comprising two or more sections or portions. Whether the intermediate ring 802 has a continuous shape or a non-continuous shape, the intermediate ring 802 is disposed below the outer rim 202 and above the ring 206, and can be used to contact (to squeeze, scrape, wipe, etc.) the applicator as the applicator passes through the intermediate ring 802 while the applicator is being removed from the container.

FIGS. 13-17 illustrate an embodiment of a can wiper 200 that includes a non-continuous intermediate ring 802 and a non-continuous lower ring 206. In other words, the intermediate ring 802 comprises at least two non-continuous sections, spanning several vanes 210 with each non-continuous section. Also, the lower ring 206 comprises at least two non-continuous sections, with each non-continuous section spanning a few vanes 210. In the illustrated embodiment, the sections of the intermediate ring 802 span opposite the sections of the lower ring 206. The embodiment of FIGS. 13-17 is shown for example, and similar embodiments can include non-continuous sections of intermediate rings 802 and/or non-continuous sections of rings 206 in different arrangements and spanning different vanes 210.

FIGS. 18-22 illustrate an embodiment of a can wiper 200 that includes a single vane 210. The single vane 210 couples a lower ring 206 to the outer rim 202. In the illustrations of FIGS. 18-22, the single vane 210 extends around the perimeter of the outer rim 202 and the lower ring 206 is non-continuous, comprising a quantity of lower ring 206 sections. Alternate embodiments can include a single vane 210 that extends partly around the perimeter of the outer rim 202 and/or a lower ring 206 that is continuous or that is non-continuous in a different arrangement of ring 206 sections.

As can be seen, the vane 210 includes a quantity of securing members 212 protruding from the vane 210. The securing members 212 may be integral to the vane 210 and may comprise a protruding structure with one or more retention features. The securing members 212 extend outward from the vane 210 and include one or more features that grasp or press against an inner surface of the container or the container opening to secure the can wiper 200 to the container.

In various embodiments, the can wiper 200 can be formed (e.g., milled, 3D printed, injection molded, etc.) from a single continuous material, such as a polymer or the like. Other materials are also contemplated, such as composites, natural or synthetic rubber, resins, or other materials and combinations. In an alternate example, portions of a can wiper 200 may be comprised of one material while other portions of the can wiper 200 are comprised of a different material. Portions of the can wiper 200 may be integral to each other or may be coupled together with adhesives, fasteners, or other techniques.

This discussion of exemplary advantages, features, and embodiments is illustrative only and is not intended to be limiting. Based on the disclosure, it will be understood that additional advantages are provided by aspects described herein. Alternative aspects will become apparent to those skilled in the art that do not depart from its scope. A skilled artisan may develop alternative means of implementing the aforementioned improvements without departing from the scope of the present disclosure It will be understood that certain features and sub combinations are of utility and may be employed without reference to other features and sub combinations and are contemplated within the scope of the claims.

The illustrations of FIGS. 1-22 are not intended to be limiting. In the various example embodiments illustrated in FIGS. 1-22, the location and position of the components, connections, and the like are for example only. Other locations and positions are contemplated and are within the scope of this disclosure. In some cases, additional or alternative components, techniques, sequences, or processes may be used to implement the techniques described herein.

CONCLUSION

While various discreet embodiments have been described throughout, the individual features of the various embodiments may be combined to form other embodiments not specifically described. The embodiments formed by combining the features of described embodiments are also within the scope of the disclosure.

What is claimed is:

1. A wiper apparatus for a product container, comprising:

an outer rim, comprising a rigid or semi-rigid ring-shaped support component arranged to rest at an opening of the product container;

a plurality of non-continuous wiper ring sections, comprising a plurality of rigid or semi-rigid lower support and wiping components arranged to be inserted into the product container, each non-continuous wiper ring section of the plurality of non-continuous wiper ring sections having a first end and a second end and including an inside edge configured for wiping or scraping product from an applicator;

a plurality of support vanes that extend from the outer rim to the plurality of non-continuous wiper ring sections and provide support to the plurality of non-continuous wiper ring sections, each of the non-continuous wiper ring sections of the plurality of non-continuous wiper ring sections being coupled to the outer rim via two of the support vanes, one support vane at each of the first and second ends of the non-continuous wiper ring sections; and a plurality of non-continuous intermediate ring sections, comprising a plurality of rigid or semi-rigid support structures disposed below the outer rim and above the plurality of non-continuous wiper ring sections, each non-continuous intermediate ring section of the plurality of non-continuous intermediate ring sections having a first end and a second end and being coupled to the outer rim via two of the support vanes, one support vane at each of the first and second ends of the non-continuous intermediate wiper ring sections, wherein the plurality of non-continuous wiper ring sections with the plurality of non-continuous intermediate ring sections form a generally ring shape in a plan view.

2. The wiper apparatus of claim 1, further comprising one or more tabs protruding from the outer rim, the one or more tabs comprising handles for grasping the outer rim.

3. The wiper apparatus of claim 1, further comprising one or more relief notches disposed on an inner perimeter of the outer rim, the one or more relief notches arranged to provide additional flexibility of the outer rim at the location of the one or more relief notches.

4. The wiper apparatus of claim 1, further comprising one or more securing members protruding outwardly from one or more of the one or more support vanes, the one or more securing members configured to engage a portion of the product container when the plurality of non-continuous wiper ring sections is inserted into the product container.

5. The wiper apparatus of claim 1, wherein the plurality of non-continuous intermediate ring sections is arranged parallel to the outer rim.

6. The wiper apparatus of claim 1, wherein the plurality of non-continuous intermediate ring sections comprises one or more discrete arc sections.

7. The wiper apparatus of claim 1, wherein the outer rim rests on a surface of the of the opening of the product container.

8. The wiper apparatus of claim 1, wherein the plurality of non-continuous wiper ring sections comprises one or more discrete straight or curved sections.

9. The wiper apparatus of claim 1, wherein a radius of the outer rim is greater than a radius of the plurality of non-continuous wiper ring sections.

10. The wiper apparatus of claim 1, wherein the wiper apparatus has a generally truncated conical shape.

11. An apparatus comprising:

an outer rim, comprising a rigid or semi-rigid ring-shaped support component;

a plurality of non-continuous wiper ring sections with two ends each, comprising one or more rigid or semi-rigid lower support and wiping components arranged in a non-continuous ring; and a plurality of support vanes that extend from the outer rim to each of the two ends of the plurality of non-continuous wiper ring sections, and provide support to the plurality of non-continuous wiper ring sections.

12. The apparatus of claim 11, wherein the apparatus is arranged to be inserted at least partly into a product container and wherein the outer rim is arranged to rest on an opening of the product container.

13. The apparatus of claim 11, wherein the outer rim includes at least one tab arranged to engage the opening of the product container.

14. The apparatus of claim 11, wherein the plurality of non-continuous wiper ring sections includes an inside edge configured for wiping or scraping product from an applicator.

15. The apparatus of claim 11, wherein each the plurality of non-continuous wiper ring sections is coupled to the outer rim via at least two of the support vanes.

16. The apparatus of claim 11, wherein the plurality of non-continuous wiper ring sections forms a generally elliptical or polygonal shape in a plan view.

17. A wiper apparatus for a product container, comprising:

an outer rim, comprising a rigid or semi-rigid ring-shaped support component arranged to rest on an opening of the product container;

a plurality of wiper ring sections and intermediate wiper ring sections arranged to form a ring shape in a plan view, the wiper ring sections each include an inside edge configured for wiping or scraping product from an applicator; and a plurality of support vanes that extend from the outer rim to the plurality of wiper ring sections and intermediate wiper ring sections, the plurality of wiper ring sections and intermediate wiper ring sections each being coupled to the outer rim by two support vanes, one support vane at each of a first and a second end of each wiper ring section and intermediate wiper ring section.

18. The wiper apparatus of claim 17, further comprising one or more securing members protruding outwardly from at least one of the one or more support vanes, the one or more securing members configured to engage a portion of the product container when the plurality of wiper ring sections is inserted into the product container.

* * * * *